US008661711B2

(12) United States Patent
Settele

(10) Patent No.: US 8,661,711 B2
(45) Date of Patent: Mar. 4, 2014

(54) BOOT WITH BOOTLACE CLAMPING

(75) Inventor: Andreas Settele, Munich (DE)

(73) Assignee: "LOWA" Sportschuhe GmbH, Jetzendorf (DE)

( * ) Notice: Subject to any disclaimer, the term of this patent is extended or adjusted under 35 U.S.C. 154(b) by 166 days.

(21) Appl. No.: 13/263,205

(22) PCT Filed: Dec. 3, 2010

(86) PCT No.: PCT/EP2010/068868

§ 371 (c)(1),
(2), (4) Date: Oct. 7, 2011

(87) PCT Pub. No.: WO2011/067388

PCT Pub. Date: Jun. 9, 2011

(65) Prior Publication Data

US 2012/0036736 A1 Feb. 16, 2012

(30) Foreign Application Priority Data

Dec. 4, 2009 (DE) ..... 10 2009 047 507

(51) Int. Cl.

| | |
|---|---|
| ***A43C 1/00*** | (2006.01) |
| ***A41F 1/04*** | (2006.01) |
| ***A43C 7/04*** | (2006.01) |

(52) U.S. Cl.
USPC ..... 36/50.1; 24/712.6; 24/714.8; 24/713.2; 24/713.3

(58) Field of Classification Search
USPC ..... 36/136, 56, 50.1, 52; 24/713.6, 713.2, 24/713.3, 713.4, 714.8
See application file for complete search history.

(56) References Cited

U.S. PATENT DOCUMENTS

| | | | | |
|---|---|---|---|---|
| 536,740 | A * | 4/1895 | Stevens | 24/712.6 |
| 5,001,847 | A * | 3/1991 | Waters | 36/50.1 |
| 5,761,777 | A * | 6/1998 | Leick | 24/714.6 |
| 5,924,178 | A * | 7/1999 | Holmberg | 24/712.5 |
| 5,979,080 | A * | 11/1999 | Borsoi | 36/50.1 |
| 6,076,241 | A * | 6/2000 | Borel | 24/712.9 |
| 6,729,000 | B1 * | 5/2004 | Liu | 24/713.2 |
| 2002/0083621 | A1 | 7/2002 | Durocher | |
| 2005/0097780 | A1 | 5/2005 | Pellegrini | |

FOREIGN PATENT DOCUMENTS

| | | |
|---|---|---|
| CH | 35 830 A5 | 10/1906 |
| CH | 674 445 A5 | 6/1990 |
| DE | 1 211 513 | 2/1966 |
| DE | 89 16 201 U1 | 12/1994 |
| DE | 44 19 808 A1 | 6/1995 |

(Continued)

*Primary Examiner* — Khoa Huynh
*Assistant Examiner* — Katharine Gracz
(74) *Attorney, Agent, or Firm* — Rothwell, Figg, Ernst & Manbeck, P.C.

(57) ABSTRACT

A boot laceable by means of a bootlace with a plurality of bootlace-deflecting elements and at least two separating units for dividing the bootlace into a bootlace portion extending in the forefoot region and a bootlace portion extending in the lower leg region, the separating units each comprising a base element fastenable to the boot and an eyelet element, fitted swivellably to the base element, in between which the bootlace may be clamped. The eyelet element comprises a substantially arched clip portion with a middle part and two clip legs. The two clip legs each comprise an opening, wherein the bootlace may be introduced through the one opening into the inside of the arch shape, passed under the middle part and passed back out of the arch shape through the other opening.

13 Claims, 3 Drawing Sheets

(56) References Cited

FOREIGN PATENT DOCUMENTS

| | | | |
|---|---|---|---|
| DE | 297 08 834 | U1 | 7/1997 |
| DE | 299 07 961 | U1 | 9/1999 |
| EP | 0 808 113 | B1 | 9/2000 |
| EP | 1 050 224 | A2 | 11/2000 |

* cited by examiner

BOOT WITH BOOTLACE CLAMPING

This application is a 35 U.S.C. 371 National Phase Entry Application from PCT/EP2010/068868, filed Dec. 3, 2010, which claims the benefit of German Patent Application No. 10 2009 047 507.9 filed on Dec. 4, 2009, the disclosure of which is incorporated herein in its entirety by reference.

The invention relates to a boot laceable by means of a bootlace, with a lower leg region and a forefoot region, each of which comprises a plurality of bootlace-deflecting elements and at least two separating units for dividing the bootlace into a bootlace portion extending in the forefoot region and a bootlace portion extending in the lower leg region, preferably for separating these bootlace portions in terms of tensile stress, the separating units each comprising a base element fastened to the boot and an eyelet element which is fitted to the base element so as to be swivellable about a swivel axis extending substantially parallel to a surface portion of the boot bearing the base element, the bootlace being clampable between the eyelet element and the base element, and the eyelet element comprising a substantially arched clip portion with a middle part and two clip legs adjoining this middle part on both sides, the swivel axis running through the free ends of the clip legs.

Known examples of such boots are hiking boots, in which in a forefoot region of the boot upper the bootlace is guided through and deflected by eyelet elements, while in a lower leg region of the boot upper it is guided through and deflected by hook elements, which may be brought straightforwardly out of engagement with the bootlace to allow the hiker to put the boot on and take it off easily. Between the regions of the eyelet elements and the hook elements a separating unit is conventionally provided on either side of an inlet in the boot upper covered by the boot tongue, i.e. on both the inside and the outside of the boot, the task of said separating unit being to separate the forefoot region and the lower leg region from one another, for example in terms of the tensile stress exerted in each case on the bootlace. In the stated example it is possible in this way on the one hand to hold the hiker's forefoot secure by appropriate tightening of the bootlace in the region of the eyelet elements in the forefoot region of the boot, while on the other hand the tensile stress in the lower leg region of the boot upper may be selected in accordance with the requirements of the terrain. For instance, the bootlace may be firmly tightened for example both in the forefoot region and in the lower leg region when hiking on screen, to provide the hiker with a secure hold, whereas when walking downhill or on flat, easy terrain only the forefoot region is laced firmly, while the lower leg region may be laced more loosely, in order to give the ankle joint greater freedom of movement and so increase walking comfort. With conventional boots the separating action is conventionally based on a "wedging in" of the bootlace between two legs of the separating unit extending towards one another and forming a tapering gap between them.

A separating unit is already known from DE-U-297 08 834, from which the precharacterising clause is derived, which comprises a base element and an eyelet element fitted swivellably to the base element. With this separating unit the bootlace is clamped firmly between the base element and the eyelet element. To this end, the eyelet element may be swivelled relative to the base element between a clamping position, in which it separates the bootlace portion extending in the forefoot region and the bootlace portion extending in the lower leg region from one another, for example in terms of tensile stress, and a release position, in which it does not exercise this separating function. To be able to move the eyelet elements of the separating units into the clamping position, lacing of the boot must be effected as follows: firstly the bootlace is tightened until it exhibits the tension desired for the portion thereof extending in the forefoot region. Then the two hands each holding one section of the bootlace are crossed over, while maintaining this tension, in order to swivel the eyelet elements of the separating units in such a way that the bootlace is clamped in between the base elements and the respectively associated eyelet element. The lower leg region may then be laced with the tension desired therefor.

Users find in particular the crossing over of the free ends of the bootlace, in particular while maintaining the tension, to be extremely laborious.

For additional prior art, reference is made to EP-B-0 808 113, CH-A-674 445, DE-U-89 16 201 and EP-A-1 050 224.

It is therefore an object of the present invention to provide a boot of the above-mentioned type which simplifies division of the bootlace into the bootlace portion extending in the forefoot region and the bootlace portion extending in the lower leg region and preferably also the provision and maintenance of different tensile stresses in the forefoot region and lower leg region.

According to the invention this object is achieved by a boot of the above-mentioned type in which the two clip legs each comprise an opening, wherein the bootlace may be introduced through the one opening into the inside of the arch shape, passed under the middle part and then passed back out of the arch shape through the other opening. Due to the configuration according to the invention of the eyelet element, in the region of the separating unit the bootlace does not extend orthogonally to the plane defined by the eyelet element, as is the case in DE 297 08 834 U1, but rather substantially in this plane. This makes it possible for the eyelet element to be moved into its clamping position by simple tightening of the bootlace, i.e. without crossing the hands over, in order to clamp the bootlace securely in between base element and eyelet element.

At this point it should be noted that the bootlace portion extending in the forefoot region conventionally comprises one continuous section of the bootlace, while the bootlace portion extending in the lower leg region is formed of two mutually independent sections connected conventionally only via the bootlace portion extending in the forefoot region.

At this point it should additionally be noted that the arch shape of the eyelet element does not necessarily need to be an "inverted U" shape. Instead, an "inverted V" shape or other suitable shape may also be used, which is open between the free ends of the clip legs. In this case the middle part is formed simply by the junction of the two legs of the "inverted V" shape. Shapes may however also be used in which the free ends of the clip legs are joined together by a further leg which forms the swivel axis, for example a "D" shape lying on its side. However, since the swivel axis is formed for manufacturing reasons preferably of a separate pin, which may be passed through orifices in the free ends of the clip portion, no clear distinction can anyway be drawn between open and closed clip shapes.

To reinforce clamping engagement between the separating unit and the bootlace, in a further development of the invention the eyelet element may comprise a projection on the inside of the middle part. This projection has a notch effect on the bootlace, which reinforces clamping engagement. Provision may additionally be made for the base element to comprise a recess corresponding to the projection. Through the interaction of projection and recess a serpentine profile is imposed on the bootlace, which reinforces the clamping action by increasing the frictional engagement between separating unit and bootlace.

As a further development of the invention, provision may be made for the clip portion to comprise at least one gripping structure on its outside. Such a gripping structure may make it easier to release the clamping engagement between separating unit and bootlace, i.e. movement of the eyelet element out of its clamping position into the release position.

At this point it should be emphasised that the eyelet element may also be released again from its clamping position without the provision of such a gripping structure. Since the bootlace extends through the eyelet element substantially in the plane defined by the eyelet element, it has merely to be held in such a way that it extends obliquely to the plane defined by the eyelet element after passing back out of the eyelet element. If the bootlace is then tightened, a force is exerted in this way on the eyelet element which swivels the eyelet element out of its clamping position towards its release position.

The gripping structure may in principle be provided by providing a friction-enhancing coating on the eyelet element. It is preferable, however, to form the gripping structure as a groove structure, wherein the grooves of the groove structure preferably extend substantially parallel to a plane defined by the arch shape of the clip portion. This purely mechanical solution has the advantage over the coating variant that it is less susceptible to the effects of the weather, for example moisture and temperature.

In addition or as an alternative, the gripping structure may comprise a nose, which is preferably arranged on a side of the eyelet element remote from the surface of the boot. In particular, the nose is to be arranged on that side of the eyelet element which is remote from the surface of the boot when the eyelet element is in the clamping position. Such a nose makes it easier to grip the gripping structure, in particular even with gloves.

To be able to make engagement with the gripping structure particularly ergonomic, in particular even with gloves, it is additionally or alternatively proposed that the gripping structure be provided on the middle part of the clip portion.

As a further development of the invention it is proposed to manufacture the base element and/or the eyelet element as a casting. It may in principle also be feasible to manufacture the base element and/or the eyelet element from plastics, for example as an injection moulding. To increase the strength and loading capacity of the separating unit it is advantageous, however, to manufacture the base element and/or the eyelet element from metal.

To simplify manufacture, the base element of the separating unit may comprise a fastening part and a clamping part. Preferably the fastening part serves to fasten the separating unit to the upper of the boot, while the clamping part works together with the eyelet element to provide the clamping engagement between separating unit and bootlace. To increase strength and loading capacity the fastening part and the clamping part may be made together in one piece.

To be able to prevent the separating unit from twisting relative to the upper of the boot under the influence of the forces exerted thereon by the bootlace, the base element, preferably the fastening part thereof, may be fastened to the upper of the boot using at least two fastening means, for example rivets.

Finally, the boot may comprise at least two heel elements, which pass the bootlace coming from the separating units on to the deflecting elements of the lower leg region. Provision of the heel elements prevents pressure points at the bend point between lower leg region and forefoot region. For example the heel element may take the form of a loop, through which the bootlace may be passed. The loop may in this case preferably be made from textile material, so as to be able to prevent the formation of pressure points on the wearer's foot.

The invention is explained in greater detail below by means of an exemplary embodiment with reference to the accompanying drawings, in which.

Figure 1:
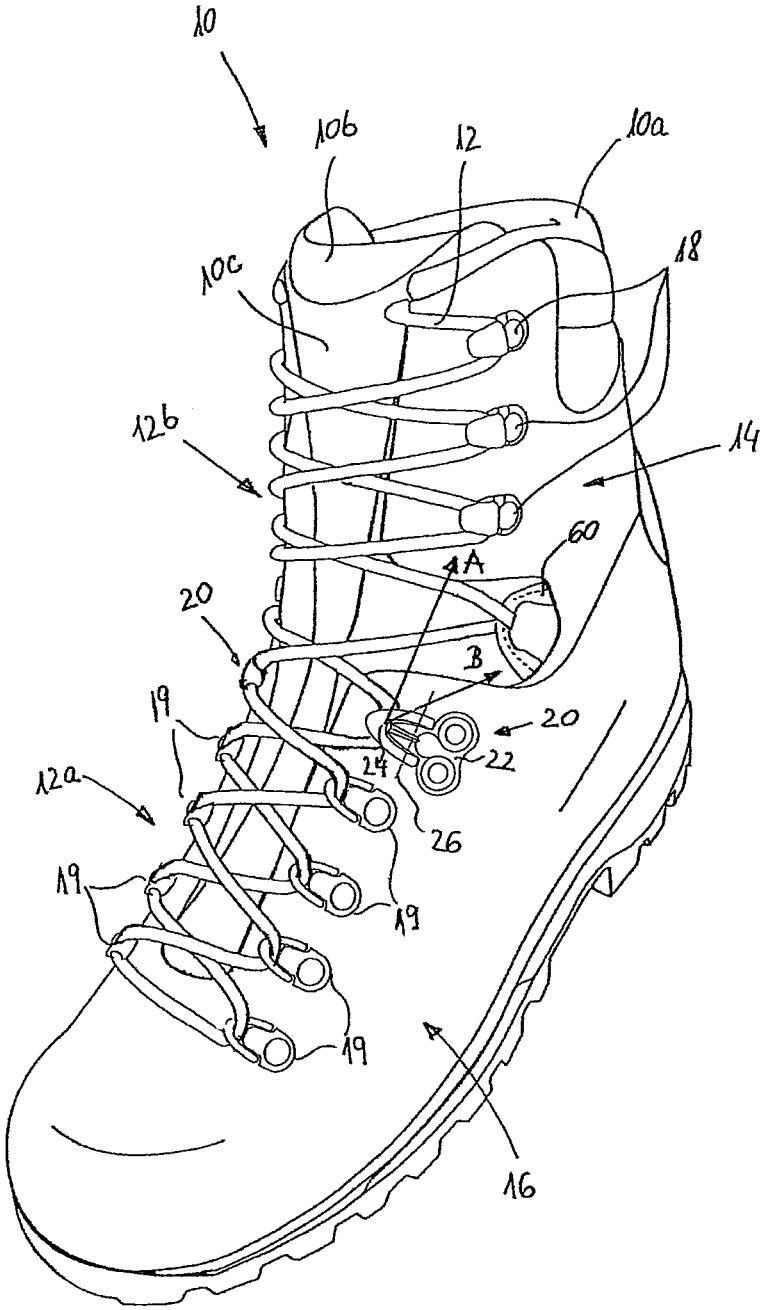
FIG. 1 is a perspective view of a boot according to the invention.

In FIG. 1 a boot according to the invention is designated overall as 10. In the forefoot region 16 of the boot upper 10*a* the boot 10 comprises eyelets 19 and in the lower leg region 14 of the boot upper 10*a* it comprises hooks 18. Two separating units 20 are further provided, whose structure and function will be explained in greater detail below. The deflecting elements 18, 19 and the separating units 20 are fastened to the boot upper 10*a* on both sides of an inlet 10*c* in the boot upper 10*a* covered by the tongue 10*b*. The eyelets 19, the separating units 20 and the hooks 18 serve as deflecting elements for a bootlace 12, which spans the inlet 10*c* a number of times in criss-cross lacing or parallel lacing, in order to hold the foot of the wearer of the boot 10 firm in the boot 10.

Reference numeral 60 denotes two heel elements (only one is visible in FIG. 1), which pass the bootlace 12 coming from the separating units 20 on to the hooks 18 of the lower leg region 14. In the embodiment shown in FIG. 1 the heel elements take the form of loops. The heel elements 60 serve to prevent pressure points at the bend point between lower leg region and forefoot region.

The present invention deals mainly with the configuration of the separating units 20, whose structure is shown in particular in FIGS. 2 to 5.

The separating units 20 have the task of decoupling from one another the portion 12*b* of the bootlace 12 associated with the lower leg region 14 and the portion 12*a* of the bootlace 12 associated with the forefoot region 16 in terms of the tensile stress with which the bootlace 12 is laced in the respective portions 12*a*, 12*b*. In this way the foot of the wearer of the boot 10 may be held secure for example in the forefoot region 16 with one desired tensile stress, independently of the value of the tensile stress in the lower leg region 14. Consequently, the wearer of the boot 10 may if desired loosen the lacing of the bootlace 12 in the lower leg region 14 to increase the freedom of the movement of his or her ankle joint and thus to increase his or her comfort, without thereby losing the secure hold of the foot in the forefoot region 16.

Figure 2:
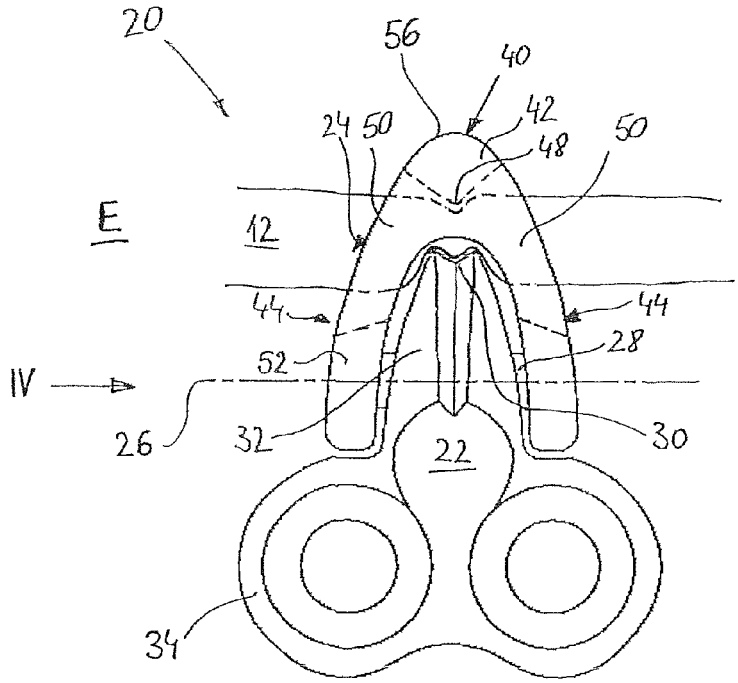
FIG. 2 is a plan view of the front of a separating unit according to the invention, as is used with the boot according to FIG. 1.
Figure 3:
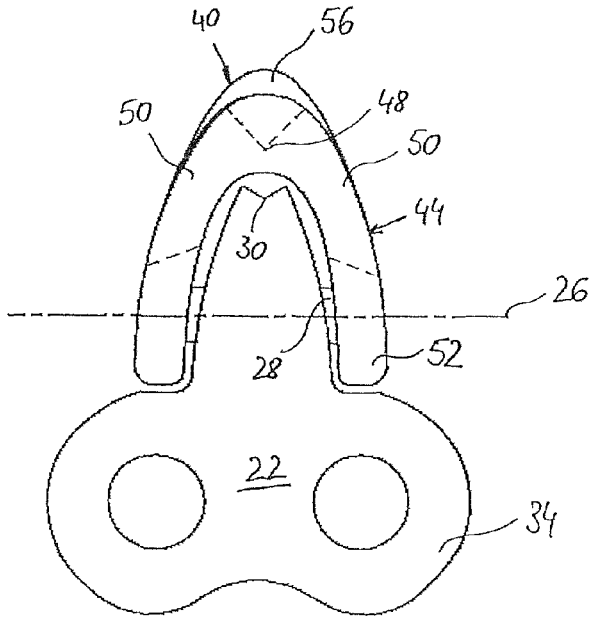
FIG. 3 is a view from below of the separating unit according to FIG. 2.

According to the plan view shown in FIG. 2 and the view from below shown in FIG. 3, the separating unit 20 comprises a base element 22 fastenable to the boot 10 and an eyelet element 24, which is fitted to the base element 22 so as to be swivellable about a swivel axis 26. The swivel axis 26 extends substantially parallel to a surface portion of the boot bearing the base element 22. The eyelet element 24 comprises a substantially U-shaped clip portion 40 with a middle part 42 and two clip legs 44 adjoining the middle part 42 on both sides thereof. In addition, the eyelet element 24 may comprise a swivel axis portion moulded on in one piece. In the exemplary embodiment, on the other hand, the swivel axis 26 takes the form of a separate pin 28, which extends through the free ends 52 of the clip legs 44. This is easier to achieve in terms of manufacturing than for example a closed clip portion in the form of a "D" lying on its side.

The two clip portions 44 of the eyelet element 24 each comprise an opening 50, through which the bootlace 12 may be passed. In addition, a projection 48 is provided on the inside of the middle part 42, and the base element 22 comprises a corresponding recess 30. The bootlace 12 passed through the openings 50 may be clamped in between the projection 48 and the recess 30, wherein it extends in the plane E defined by the eyelet element 24.

The base element 22 of the separating unit 20 comprises a fastening part 34, which may be fastened to the upper 10*a* of the boot 10 with two fastening elements 36 (see FIGS. 4 and 5), for example rivets, and a clamping part 32, which in this embodiment is in one piece with the fastening part 34. The recess 30 is formed in the clamping part 32.

Figure 4:
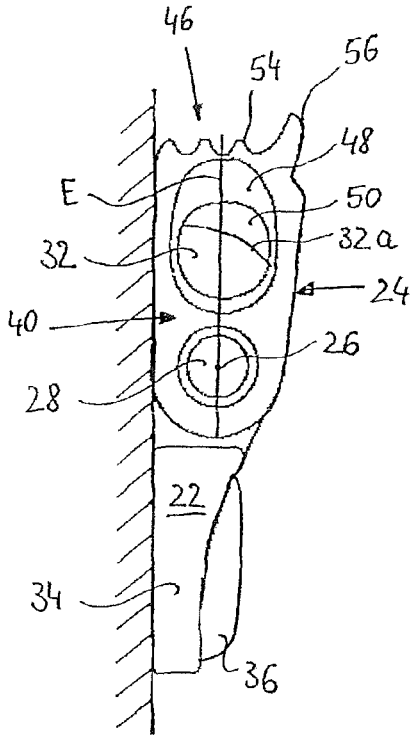
FIG. 4 is a side view viewed in the direction of arrow IV in FIG. 2 of the separating unit of FIG. 2 in the clamping position.
Figure 5:
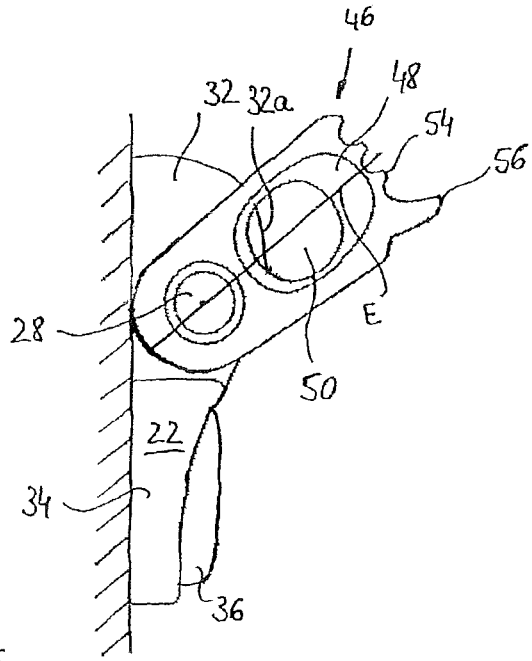
FIG. 5 is a side view of the separating unit of FIG. 2 in the release position.

In the side view of the separating unit 20 according to FIG. 4 a gripping structure 46 of the eyelet element 24 is additionally visible. In the exemplary embodiment illustrated, the gripping structure 46 takes the form of a groove structure, on the middle part 42 of the clip portion 40. The grooves 54 of the gripping structure 46 preferably extend substantially parallel to the plane E. On the side of the eyelet element 24 remote from the surface of the boot 10, the groove structure is bounded by a nose 56 projecting particularly far. The gripping structure 46 and in particular the nose 56 simplifies release of the clamping engagement between separating unit 20 and bootlace 12.

Operation of the separating unit 20 will be explained below: If the bootlace 12 is pulled substantially along the lower leg, i.e. in FIG. 1 in the direction of arrow A, the eyelet elements 24 swivel out of the release position (see FIG. 5) in the direction of the clamping position (see FIG. 4). In this way, the respective middle parts 42 of the eyelet elements 24 approach the associated clamping parts 32 of the base element 22. The distance between the projection 48 of the eyelet elements 24 and the recess 30 in the base elements 22 extending over substantially the entire top 32*a* of the clamping part 32 reduces, whereby the bootlace 12 is increasingly clamped in between eyelet element 24 and clamping part 32 as the swivel movement continues. This clamping action is maintained by the separating units 20 during subsequent lacing of the bootlace 12 in the lower leg region 14. It is not necessary to cross the hands over to achieve the clamping action.

To release the clamping engagement it is merely necessary to pull on the bootlace 12 in a direction which extends obliquely relative to the plane E, which the eyelet element 24 defines when located in its clamping position, for example the direction indicated in FIG. 1 by the arrow B. In this way, a force is exerted on the eyelet element 24 which is designed to swivel the latter out of its clamping position towards its release position.

The eyelet element 24 may however also be moved out of the clamping position by gripping the gripping structure 46 and releasing it "by hand" from the clamping position. In this case, the nose 56 simplifies handling, such that the hiking boots 10 may for example also be laced up with gloved fingers.

The invention claimed is:

1. A boot laceable by means of a bootlace, comprising:

a lower leg region and a forefoot region, each of which comprises a plurality of bootlace-deflecting elements, and at least two separating units for dividing the bootlace into a bootlace portion extending in the forefoot region and a bootlace portion extending in the lower leg region, wherein the separating units each comprise a base element fastened to the boot and an eyelet element, which is fitted to the base element so as to be swivellable about a swivel axis extending substantially parallel to an outer surface portion of the boot bearing the base element, wherein the bootlace is clampable in between the eyelet element and the base element, wherein the eyelet element comprises a substantially arched clip portion with a middle part and two clip legs adjoining the middle part on both sides, and wherein the two clip legs each comprise a free end, wherein the swivel axis runs through the free ends of the two clip legs, wherein the two clip legs each comprise an opening, and wherein the two clip legs are configured to allow the bootlace to be introduced through the opening of one of the clip legs into an inside of the arched clip portion, passed under the middle part and passed back out of the arched clip portion through the opening of the other clip leg.

2. The boot according to claim 1, wherein the eyelet element comprises a projection formed on the inside of the middle part.

3. The boot according to claim 2, wherein the base element comprises a recess corresponding to the projection.

4. The boot according to claim 1, wherein the clip portion comprises at least one gripping structure on the outside of the clip portion.

5. The boot according to claim 4, wherein the gripping structure takes the form of a groove structure, wherein a groove portion of the groove structure extends substantially parallel to a plane defined by the arched clip portion.

6. The boot according to claim 4, wherein the gripping structure comprises a nose arranged on a side of the eyelet element remote from the surface of the boot.

7. The boot according to claim 4, wherein the gripping structure is provided on the middle part of the clip portion.

8. The boot according to claim 1, wherein the base element and/or the eyelet element are/is a casting.

9. The boot according to claim 1, wherein the base element comprises a fastening part and a clamping part.

10. The boot according to claim 1, wherein the base element is fastened to an upper portion of the boot by means of at least two fastening means.

11. The boot according to claim 1, wherein at least two heel elements are further provided, which pass the bootlace coming from the at least two separating units on to the deflecting elements of the lower leg region.

12. The boot according to claim 1, wherein the base element and/or the eyelet element are/is a metal casting.

13. The boot according to claim 9, wherein the fastening part and the clamping part are one piece.

* * * * *